US005284211A

United States Patent [19]

Tozer

[11] Patent Number: 5,284,211

[45] Date of Patent: Feb. 8, 1994

[54] GROUND SURFACE DEBRIS COLLECTION MAT

[75] Inventor: Warwick Tozer, Eltham, Australia

[73] Assignee: Slevin Pty. Ltd., Victoria, Australia

[21] Appl. No.: 772,368

[22] PCT Filed: May 2, 1990

[86] PCT No.: PCT/AU90/00173

§ 371 Date: Jan. 14, 1992

§ 102(e) Date: Jan. 14, 1992

[87] PCT Pub. No.: WO90/13712

PCT Pub. Date: Nov. 15, 1990

[30] Foreign Application Priority Data

May 3, 1989 [AU] Australia ..... PJ4000/89
Aug. 3, 1989 [AU] Australia ..... PJ5601/89

[51] Int. Cl.[5] ..... E01H 1/00; A63B 47/02

[52] U.S. Cl. ..... 172/29; 172/189; 172/197; 172/199; 172/612; 172/684.5

[58] Field of Search ..... 172/612, 445.1, 684.5, 172/189, 197, 199, 29

[56] References Cited

U.S. PATENT DOCUMENTS

| | | | |
|---|---|---|---|
| 1,446,419 | 2/1923 | Glerum | 172/612 |
| 1,530,329 | 3/1925 | Roberts | 172/612 |
| 2,042,405 | 5/1936 | Knudson | 172/189 |
| 2,287,133 | 6/1942 | Reiter | 56/328.1 X |
| 2,887,337 | 5/1959 | Begue . | |
| 2,902,909 | 9/1959 | Reissinger | 172/612 |
| 4,651,450 | 3/1987 | York et al. | 172/189 X |

FOREIGN PATENT DOCUMENTS

| | | | |
|---|---|---|---|
| 13527/66 | 11/1966 | Australia . | |
| 8218672 | 8/1982 | Fed. Rep. of Germany . | |
| 669812 | 2/1986 | Switzerland . | |
| 640312 | 7/1950 | United Kingdom | 172/612 |

OTHER PUBLICATIONS

McPherson's Industrial Catalog, Sep. 3, 1975 by McPherson's Ltd., p. 287.

*Primary Examiner*—Eric K. Nicholson
*Assistant Examiner*—Christopher J. Novosad
*Attorney, Agent, or Firm*—Sughrue, Mion, Zinn, Macpeak & Seas

[57] ABSTRACT

A mat for sweeping a surface is provided with an elongated slot therethrough which extends transverse to the intended direction of movement of the mat over a surface whereby debris on the surface will pass upwardly through the slot for collection on the upper surface of the mat. The slot may be perpendicular or angled relative to the direction of travel and the trailing edge of the slot may be provided with a chamfered surface to assist in guiding debris upwardly onto the upper surface of the mat. The mat may be either a one piece flat flexible mat or may be comprised of a plurality of mat elements each of which has a slot therethrough and which may be connected to other mat elements to make a larger mat.

30 Claims, 7 Drawing Sheets

GROUND SURFACE DEBRIS COLLECTION MAT

This invention relates to a mat for collecting debris, such as leaves and sticks, from a surface, such as the surface of a tennis court.

Outside playing courts, such as tennis courts, are often prone to accumulating leaves or other debris on their surface which must be periodically removed.

According to the present invention there is provided a mat for sweeping a surface, said mat comprising slots through which debris, such, as leaves or sticks, can pass to collect on the upper surface of the mat.

The mat is preferably composed of a semi-flexible material, such as rubber or a suitable polymeric material.

The slots are preferably elongate with the longitudinal axis of each slot facing generally in the direction of travel of the mat. Preferably the trailing edge of each slot is chamfered to lift debris onto the upper surface of the mat. The trailing edge of each slot may face perpendicularly to the direction of travel or may be inclined, for example at 45°. In the mat, all of the slots may be inclined to the direction of travel, or some may be inclined with others being perpendicular to the direction of travel.

In one particularly advantageous form, the mat is of a grid-like construction for "bagging" a clay tennis court, with portions of the grid being removed to define the slots. Thus "bagging" of the court periodically during play will also serve to remove leaves and other debris from the surface of the court.

An embodiment of the invention will now be described by way of example only with reference to the accompanying drawings in which.

Figure 1:
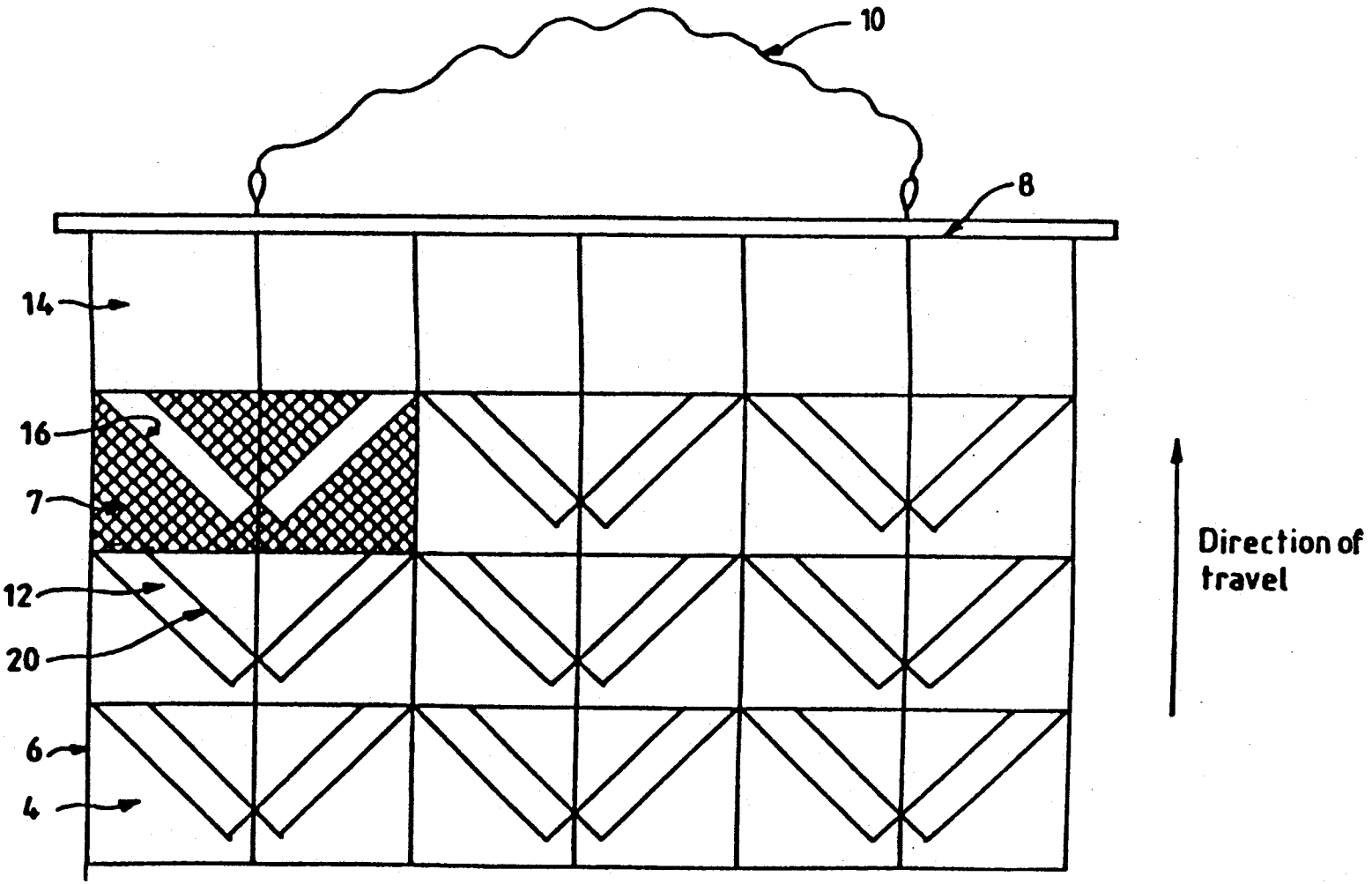
FIG. 1 is a diagrammatic plan view of a mat in accordance with the invention and having slots for collecting the debris.
Figure 6:
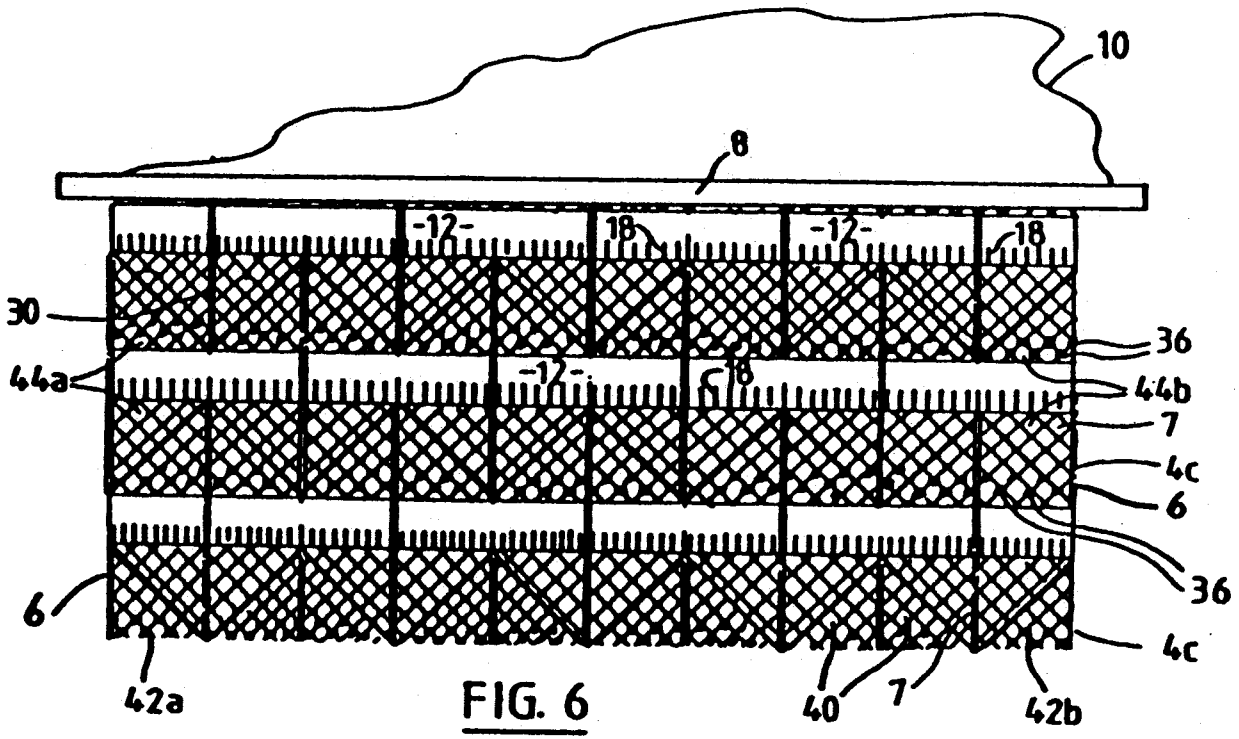
FIG. 6 is a plan view of a modified form of mat formed in accordance with the invention.
Figure 7:
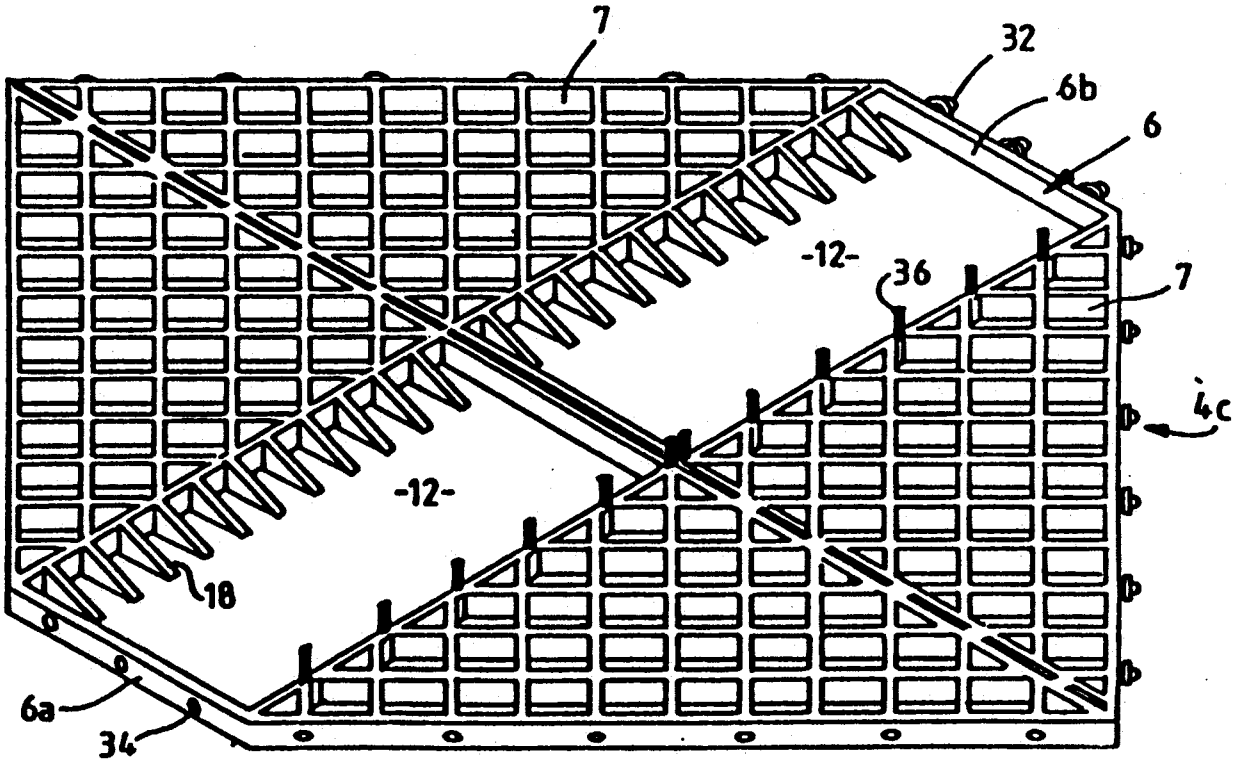
Figure 8:
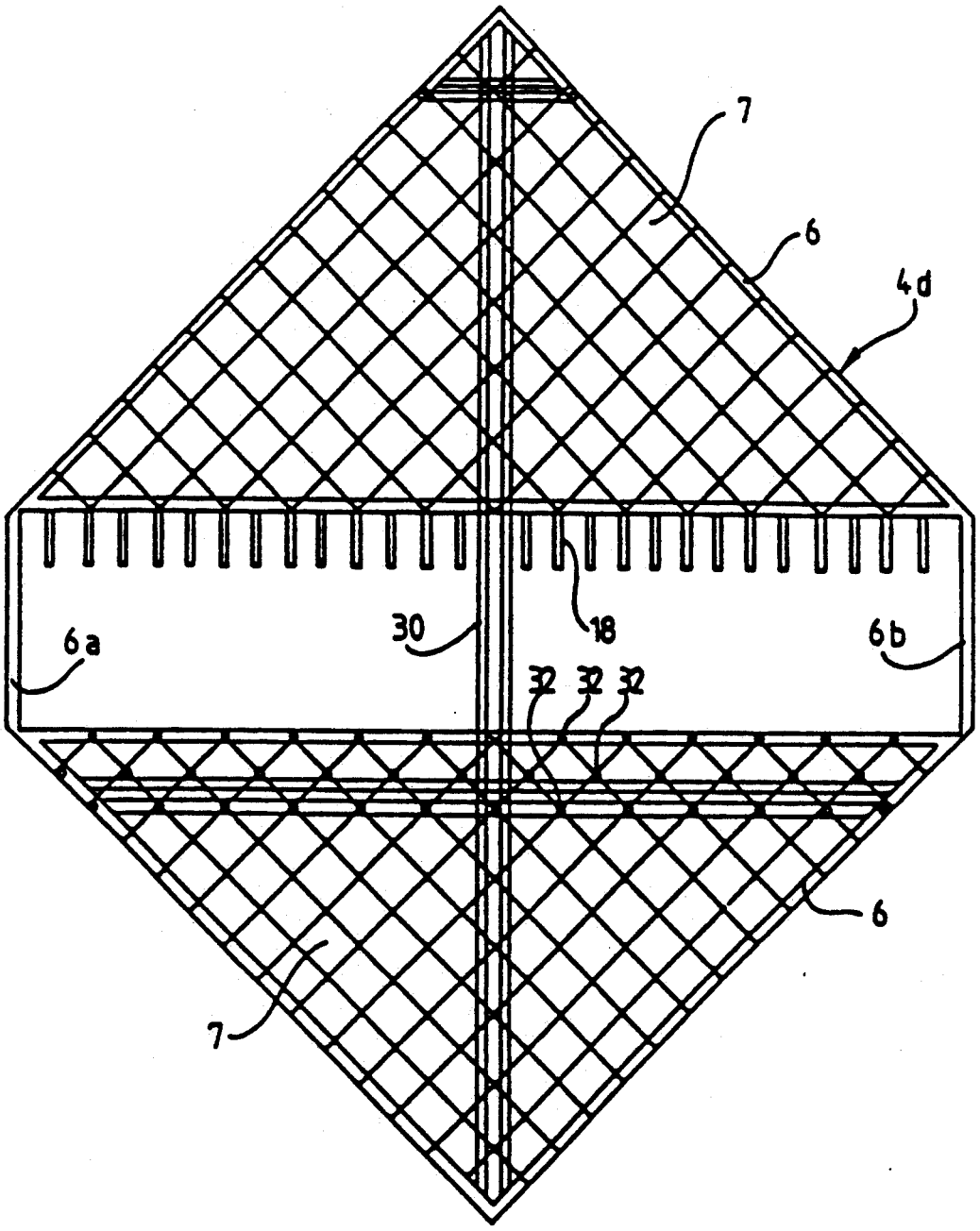

FIG. 7 is a perspective view of a mat element forming part of the mat of FIG. 6; and FIG. 8 is a partly diagrammatic plan view of another form of mat element As shown in FIG. 1 of the accompanying drawings a mat for bagging a clay tennis court comprises a grid-like, semi-flexible material. Preferably, the mat is composed of rows of separately formed rectangular elements 4 each comprising an outer border 6 which surrounds a grid-like formation 7, with the axes of the grid extending approximately at 45° to the edges of the element 4. The elements 4 are fastened together to form the mat by lugs projecting from the border 6 of one element to fit into holes correspondingly formed in the adjacent border of the adjacent element. A strip 8 at the leading edge of the mat carries a rope-like handle 10 by which the mat can be dragged along the surface of the court.

At least some of the elements 4 have elongate slots 12 formed within the grid-like formation 7. It is not necessary to put the elongate slots 12 in the first row 14 of elements 4 forming the mat as this row is usually lifted at least partially from the court in the dragging action, but preferably each of the other elements is provided with a slot 12. It is not, however, essential for all of the other elements to be provided with slots and satisfactory results may be obtained if only some of the other elements have slots suitably distributed along the length and width of the mat.

Figure 2:
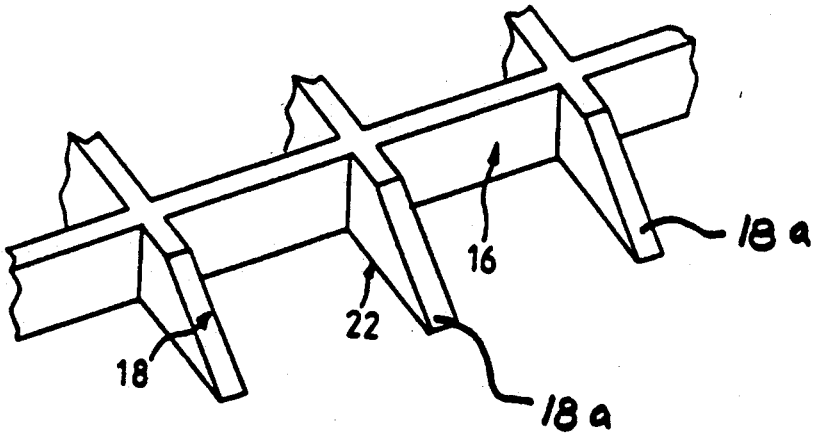
FIG. 2 is a perspective view to an enlarged scale showing part of the trailing edge of one of the slots.

The longitudinal dimension of each slot 12 is in this case parallel to that of the grid. Preferably the slots 12 of adjacent elements in the same row are oppositely inclined to define a herringbone-like pattern. Alternatively, some or all of the slots 12 may be substantially at right angles to the direction of travel As shown in FIG. 2, the trailing edge 16 of each slot 12 is chamfered by shaping the projecting edge portion 18 of the grid 7 which extends into the slot. As shown this forms forwardly projecting finger elements 18*a*. The chamfer of the trailing edge facilitates lifting of the debris onto the upper surface of the mat. The leading edge 20 of each slot 12 may also be chamfered.

In a modified embodiment having slots inclined to the direction of travel the projecting edge portion 18 of the grid 7 may be angled so as to be aligned directly in the direction of travel of the mat. The lower edge 22 of the projecting edge portion 18 may also extend below the lower surface of the grid 2 to further facilitate the lifting action of the debris onto the upper surface of the mat.

As the mat is dragged along a clay court in order to bag the surface, this will also have the effect of collecting the debris, such as leaves, from the court by passing through the slots onto the upper surface of the mat. Although all of the debris will not necessarily be collected in a single pass, successive baggings of the court will serve to completely remove all of the debris. The slots also act to reduce the frictional drag of the mat.

Although the mat particularly described is primarily designed for a clay court in order to remove debris while bagging the court, the mat can also be used on a synthetic grass court or other grassed surfaces, such as lawns or playing fields, just for the purpose of removing leaves or other debris. The mat has also proven effective in gathering leaves and other debris on hard surfaces, such as concrete and "Plexipave".

The mat may also be used to sweep a beach or other surface in order to remove debris. For this purpose the mat need not necessarily be of grid-like construction. When the debris is likely to consist of bottles and other relatively larger matter, the slots will be of an appropriate size to accommodate this.

Figures 3, 4:
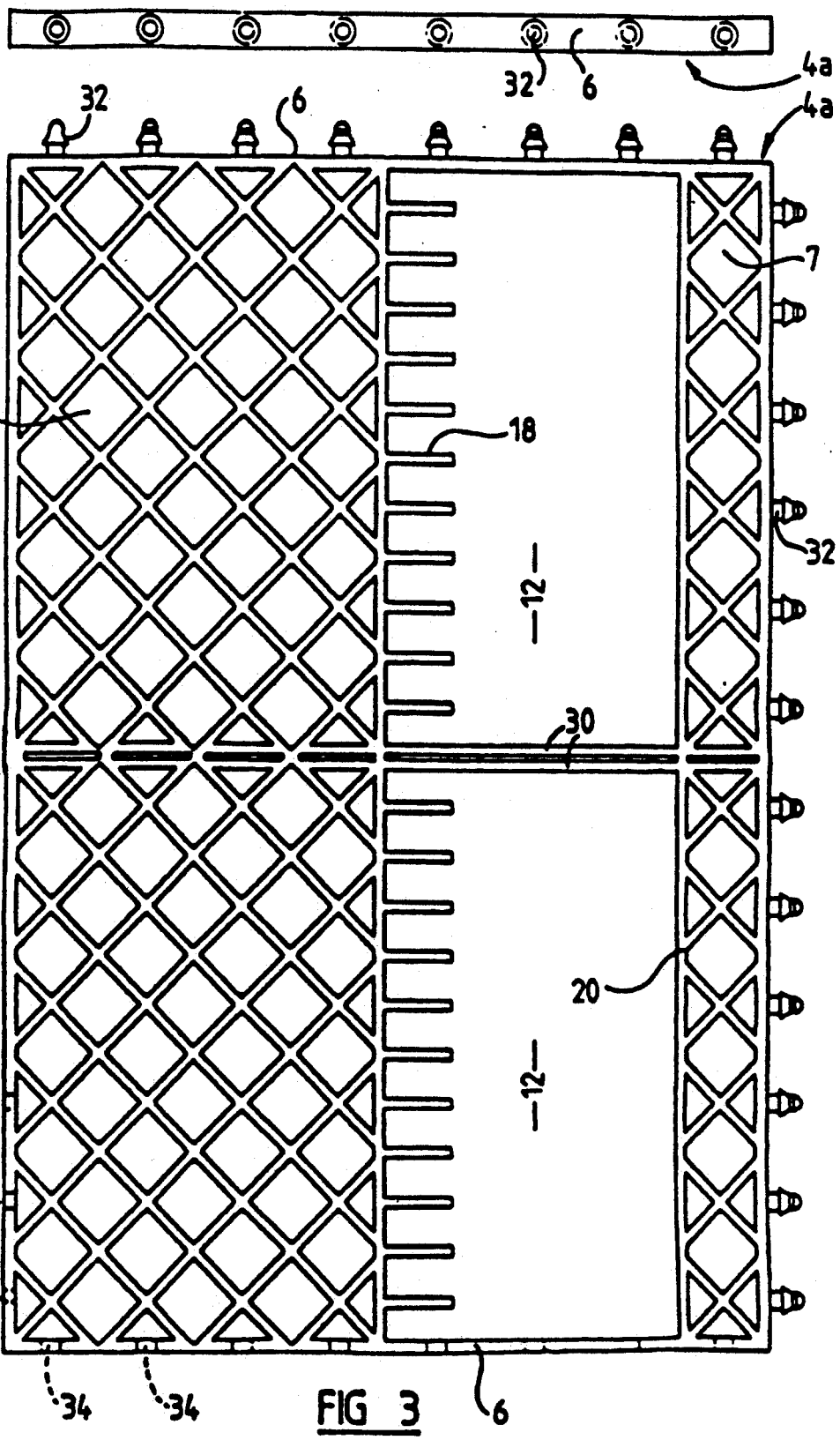
FIG. 3 is a plan view of a mat element formed in accordance with the invention.
FIG. 4 is a side view of the mat element of FIG. 3.
Figure 5:
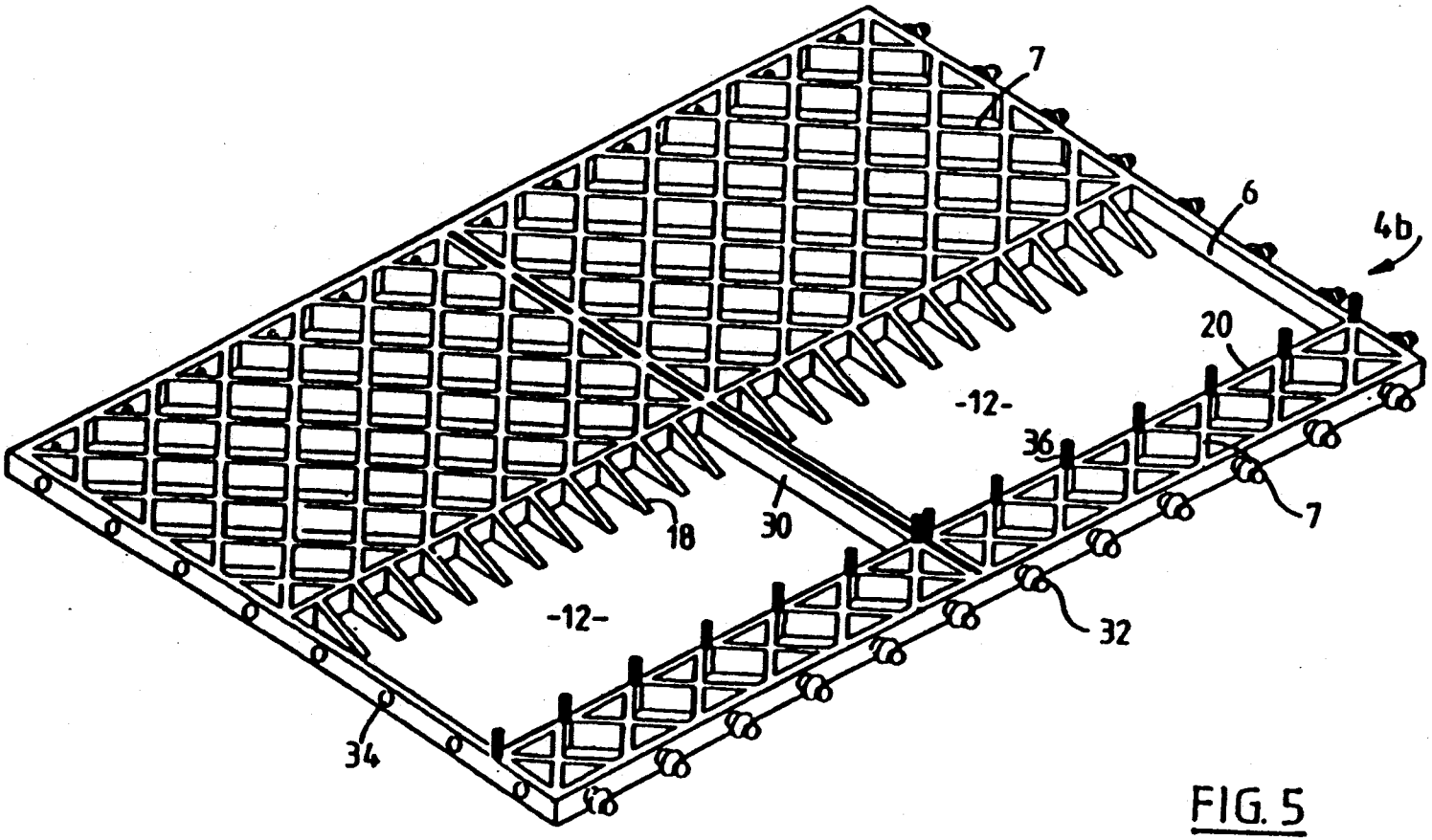
FIG. 5 is a perspective view of a mat element like that in FIG. 3 but incorporating a modification.

The mat element 4*a* of FIG. 3 and the element 4*b* of FIG. 5 are generally similar to that of FIGS. 1 and 2 and like references denote like parts in FIGS. 1, 2, 3, 4 and 5.

In these instances, the slots 12 extend from side to side of the elements, while front to rear extending central strengthening ribs 30 are provided. FIG. 3, 4 and 5 also show co-operating protrusions 32 and recesses 34 on the outer borders 6 which permit snap fitting of the elements together to form the mat.

In FIG. 5 the element 4*b* has a row of upstanding projections 36 at the part of grid-like formation defining the front edge of slot 12. These assist in the action of retaining picked up debris on the formation 7. They may be provided at additional or alternative locations on the elements 4, 4*a*, 4*b* such as at side edges or on the rear part of the formation 7. More than one row, such as staggered rows of these may be provided The projections may be of spigot-like form, as shown, or may be othewise formed such as by upstanding fence-like structures.

The modified mat shown in FIG. 6 is of similar form to that of FIG. 1, but the component elements 4c are here of hexagonal form, as best shown in FIG. 7, with the slots 12 extending at 90° to front to rear extending parallel side portions 6a, 6b of the border 6.

The elements 4c snap fit together in similar fashion to elements 4, 4a, 4b. As shown, upstanding projections 36 are again provided in this instance. The forward portions of the elements 4c may be left together to present a saw-tooth like front edge to the mat, but we prefer to cut portions 40, 42a, 42b, 44a, 44b from elements 4c and snap fit them to the elements in the mat to form a straight edged mat. In this case, too, the elements are again provided with the front to rear extending strengthening ribs 30, these extending from front to rear pointed ends of the elements.

The mat element 4d of FIG. 8 is somewhat similar to that of FIGS. 6 and 7.

The mat elements 4c and 4d have the slots 12 positioned mid way between front and rear ends thereof, but these slots may be positioned closer to the front or rear ends. The former is shown in FIGS. 6, 7 and 8. In any event, as shown, the slots in side-by-side elements 4c or 4d may be aligned in the side to side direction of the mat.

The described mat is formed from, for example, plastics materials but could be formed from other materials. For example, it may be formed from relatively hard material such as metal. Preferably though even in this case it should form a relatively flexible and/or resilient structure. In any event too, the structure, however formed, may be of different scale, such as larger, than the sizes employed in the exemplary constructions which are designed mainly for use on tennis courts with total side to side dimensions of the order of two or three meters. The term "mat" as used in this specification is to be understood as encompassing such differently constructed or differently sized structures.

The described construction has been advanced merely by way of explanation and many modifications and variations may be made thereto without departing from the spirit and scope of the invention as defined in the appended claims.

What is claimed is:

1. A mat for sweeping a surface comprising a substantially flat mat of grid-like, semi-flexible material having a leading edge for pulling the mat over a surface in a direction of travel substantially transverse to said leading edge wherein portions of said grid-like material are missing to define at least one elongated open slot having a leading edge and a trailing edge extending therethrough and disposed transversely relative to the direction of travel whereby debris can pass through each slot over the trailing edge thereof to collect on an upper surface of the mat.

2. A mat as claimed in claim 1 formed of hard material.

3. A mat as claimed in claim 2, wherein said material is metal.

4. A mat as claimed in claim 1 composed of a semi-flexible material.

5. A mat as claimed in claim 4, wherein said semi-flexible material is rubber or a polymeric material.

6. A mat as claimed in claim 1, wherein the trailing edge of each slot is chamfered to lift debris onto the upper surface of the mat.

7. A mat as claimed in claim 6, wherein the trailing edge of each slot is perpendicular to the direction of travel.

8. A mat as claimed in claim 6, wherein the trailing edge of each slot is inclined to the direction of travel of the mat.

9. A mat as claimed in claim 8, wherein the trailing edge of each slot is inclined at 45° to said direction of travel.

10. A mat as claimed in claim 8, wherein the trailing edge of each slot is provided with finger elements projecting in the direction of travel of the mat.

11. A mat as set forth in claim 10, wherein said grid-like material of said mat provides a debris support formation rearwardly of said slot having upper and lower surfaces and wherein said finger elements have an upper surface which slopes downwardly toward said leading edge of said slot to provide the chamfer of the trailing edge of each slot and wherein a lower surface of said finger elements extends marginally below said lower surface of said support formation.

12. A mat as claimed in claim 6, wherein a plurality of slots are provided with said slots extending transverse to the direction of travel.

13. A mat as claimed in claim 6, wherein said trailing edge of each slot has finger elements projecting toward said leading edge of said slot.

14. A mat as claimed in claim 1 formed of elements of generally rectangular configuration affixed to each other at edges thereof.

15. A mat as claimed in claim 1, wherein a support formation is provided with upstanding barrier means for retaining collected debris on said upper surface of said support formation.

16. A mat as claimed in claim 15, wherein said barrier means is comprised of at least one transverse row of upstanding projections.

17. A mat element for forming a mat for sweeping a surface, said mat element comprised of a substantially flat, grid-like, semi-flexible material with portions of the grid-like material missing to define an elongated open slot with a leading edge and a trailing edge extending therethrough, said mat element having connection means thereon for connection to other mat elements to provide a mat adapted to be dragged over a surface in a direction of travel transverse to said elongated slot whereby debris can pass through said slot to collect on an upper surface thereof.

18. A mat as claimed in claim 17 formed of hard material.

19. A mat as claimed in claim 18, wherein said material is metal.

20. A mat as claimed in claim 17 composed of a semi-flexible material.

21. A mat as claimed in claim 20, wherein said semi-flexible material is rubber or a polymeric material.

22. A mat as claimed in claim 17, wherein the trailing edge of each slot is chamfered to lift debris onto the upper surface of the mat element.

23. A mat as claimed in claim 22, wherein the trailing edge of each slot faces perpendicular to the direction of travel.

24. A mat as claimed in claim 22, wherein the trailing edge of said slot is inclined to the direction of travel of the mat.

25. A mat as claimed in claim 24, wherein the trailing edge of each slot is inclined at 45° to said direction of travel.

26. A mat element as claimed in claim 24, wherein the trailing edge is provided with finger elements which project toward said leading edge of said slot.

27. A mat element as claimed in claim 26, wherein said grid-like material of said mat provides a debris support formation rearwardly of said slot having upper and lower surfaces and wherein said finger elements have an upper surface which slopes downwardly toward said leading edge of said slot to provide the chamfer of the trailing edge of each slot and wherein a lower surface of said finger elements extends marginally below said lower surface of said support formation.

28. A mat element as claimed in claim 27, further comprising upstanding barrier means on said support formation for retaining collected debris on said upper surface of the support formation.

29. A mat element as claimed in claim 28, wherein said barrier means is comprised of at least one transverse row of upstanding projections.

30. A mat as claimed in claim 17, wherein said trailing edge has finger elements projecting toward said leading edge of said slot.

* * * * *